US005618191A

United States Patent [19]

Chikano et al.

[11] Patent Number: 5,618,191

[45] Date of Patent: Apr. 8, 1997

[54] ELECTRICAL CONNECTOR

[75] Inventors: Koji Chikano, Uji; Youichiro Azuma, Hino, both of Japan

[73] Assignee: Kel Corporation, Tokyo, Japan

[21] Appl. No.: 553,061

[22] Filed: Nov. 3, 1995

[51] Int. Cl.[6] ..... H01R 4/66

[52] U.S. Cl. ..... 439/108; 439/608

[58] Field of Search ..... 439/108, 65, 78, 439/101, 608

[56] References Cited

U.S. PATENT DOCUMENTS 4,762,500 8/1988 Dola et al. ..... 439/79

5,199,880 4/1996 Arai ..... 439/65

*Primary Examiner*—Gary F. Paumen

*Assistant Examiner*—Christopher Goins

*Attorney, Agent, or Firm*—Robert W. J. Usher

[57] ABSTRACT

An electrical connector comprises a first connector half having two rows of first contacts in an insulative housing and a second connector half having two rows of second contacts in an insulative housing. When the second connector half is fitted with the first connector half, the second contacts mate with the first contacts. In addition to these contacts, a plurality of third contacts are provided with a predetermined pitch extending between the first contacts in the first connector half, and a plurality of fourth contacts are provided with the same pitch extending between the second contacts in the second connector half. The fourth contacts are positioned in such a way that when the first connector half and the second connector half are fitted together, the fourth contacts will be offset in the direction of their alignment with respect to the third contacts by a distance of half the pitch. As a result, when both connector halves are fitted together, respective third contacts engage respective fourth contacts positioned on the right and left, one after another, whereby the third contacts and the fourth contacts are connected consecutively in a zigzag pattern in the longitudinal direction of their alignment.

14 Claims, 8 Drawing Sheets

ELECTRICAL CONNECTOR

FIELD OF THE INVENTION

The present invention generally relates to an electrical connector assembly of the type having two intermatable, plug and receptacle connector halves; and more particularly to such electrical connector in which each connector half has two rows of electrical contacts and a row of grounding contacts therebetween, whereby the grounding contacts function as an electrical shield.

BACKGROUND OF THE INVENTION

This type of connector is disclosed, for example, in U.S. Pat. No. 4,762,500. The connector disclosed is composed of intermatable plug connector and receptacle connectors, each provided with two rows of electrical contacts. The plug and receptacle connectors are electrically connected together when they are mated by interconnecting corresponding pairs of contacts. In addition to those contacts, each connector half is provided with a plurality of planar contacts extending longitudinally between the two rows of contacts, so that each planar contact is connected with the corresponding planar contact of its pair when the plug connector and the receptacle connector are mated with each other.

Further, each of the planar contacts interconnected as described above is grounded by being connected to a grounding terminal, and the planar contacts together function as an electrical shield between the two rows of contacts in order to prevent, e.g., cross talk of signals.

As the planar contacts in the connector are applied as a shield, and each planar contact provided between the two rows of contacts is electrically independent, it is necessary for each planar contact to be connected to a grounding terminal. For this reason, each planar contact of the prior connector must be is provided with an outwardly extending lead for insertion and soldering into a through-hole, traced for grounding on a printed circuit board.

As the connector is constructed as described above, it is necessary not only for each planar contact to be formed with a lead, but also for the printed circuit board to be formed with a corresponding number of through-holes for the leads, thus presenting the problem of additional restrictive requirements to be met when designing circuit patterns of the printed circuit board.

Furthermore, in the connector of the above U.S. patent, the two rows of contacts are assembled with the housing by insertion therein from the outer or base face (lower side) of the housing, but the planar contacts are inserted therein from the inner or mating face (upper side) of the housing thus presenting the problem of requiring a plurality of assembly steps.

SUMMARY OF THE INVENTION

The present invention was conceived to solve these problems. It is an object of the present invention to provide an electrical connector assembly of the type having planar contacts for grounding extending between the two rows of contacts in each connector half in which all the planar contacts are grounded when any one of the planar contacts is connected to a grounding terminal.

It is another object of the present invention to provide a connector constructed so that the planar ground contacts can be divided into at least two groups by one or more of the planar ground contacts to be removed, thereby enabling use of one group for supplying power and the other group for grounding.

It is yet another object of the present invention to provide a connector constructed so that the total heights of the connecting portions of each group of the planar contacts so divided, are different whereby the planar contacts of respective groups are interconnected sequentially when the connector halves are moved into mating engagement with each other.

In order to attain these objects, the present invention provides a connector comprising a first connector half having two rows of first contacts in an insulative housing and a second connector half having two rows of second contacts in an insulative housing, the second contacts mating with the first contacts when the second connector half is fitted mated with the first connector half. Further, a plurality of third contacts extend at a predetermined pitch between the first contacts in the first connector half, and a plurality of fourth contacts extend at the same pitch between the second contacts in the second connector half. The fourth contacts are positioned in such a way that when the first connector half and the second connector half are mated together, the fourth contacts will be offset longitudinally (in the direction of their alignment) with respect to the third contacts by a distance of half the pitch. As a result, when both connector halves are fitted or mated together, each third contact touches the fourth contacts positioned on the right and left, thereof, one after another, whereby the third contacts and the fourth contacts are connected consecutively in a zigzag pattern, longitudinally, in the direction of their alignment. The third contacts and the fourth contacts can be used as grounding contacts with at least one of these contacts having a lead portion to be connected to a grounding terminal. As the third contacts and the fourth contacts are connected consecutively in the direction of their alignment, (the longitudinal direction), grounding any one of these contacts grounds all of the contacts. As a result, the number of grounding terminals (through-holes for grounding) required on the printed circuit board on which the connector half is mounted can be reduced, whereby the degree of freedom in positioning through-holes for grounding is increased, easing the design of circuit patterns on the circuit board.

Furthermore, by removing at least one of the third contacts or fourth contacts, at the position of the removal, at least two groups of consecutively connected contacts are made available, whereby one group may be used for grounding and the other for supplying power.

In this way, it is possible for the third contacts and fourth contacts to be utilized for two different, applications, one as an electrical shield and the other as a power supply line.

When these contacts are used as described above, it is preferable that the maximum total height of the contacting portions of the first contacts and second contacts (i.e the sum of the height of the tallest first contact plus the height of the tallest corresponding second contact connecting thereto) is lower than the maximum total height of the tallest corresponding ground contacts, and the maximum total height of the tallest corresponding ground contacts be higher than the maximum total height of the contacts for supplying power, and the maximum total height of the contact portions of the first contacts and second contacts be lower than the maximum total height of the contacts of the group for supplying power.

As a result of the difference in heights of contacts having different applications when the first connector half and the second connector half are being moved together, first the group of contacts for grounding are interconnected into mating engagement, then the groups of contacts used for supplying power are interconnected, and lastly the first contacts and the second contacts, which are used ordinarily, for signal transmission, are interconnected, thus establishing a sequential connection of the contacts.

DESCRIPTION OF THE PREFERRED EMBODIMENTS

Figure 2:
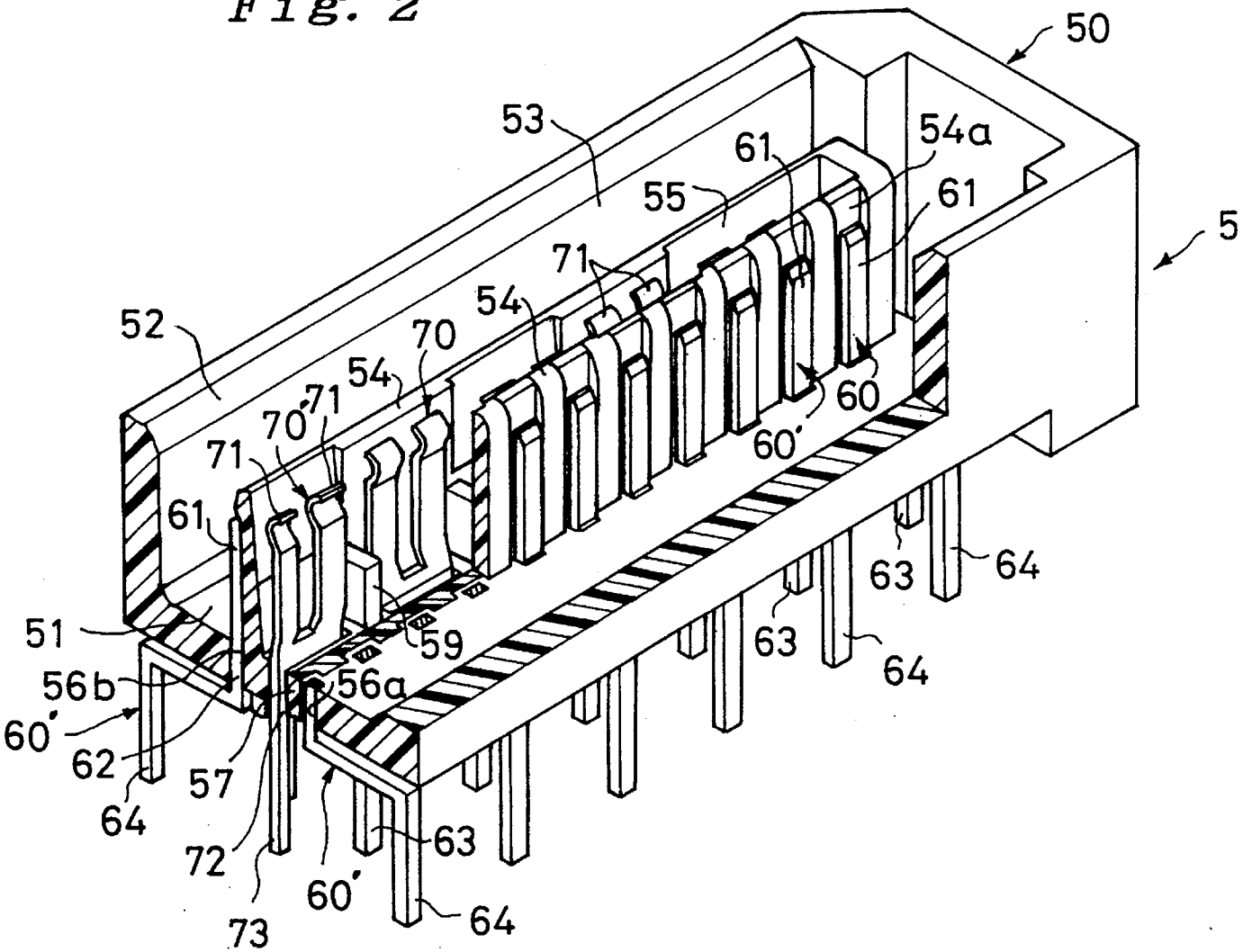
FIG. 2 shows a perspective, partially cut away view of a plug connector as a preferred embodiment of the present invention.
Figure 3:
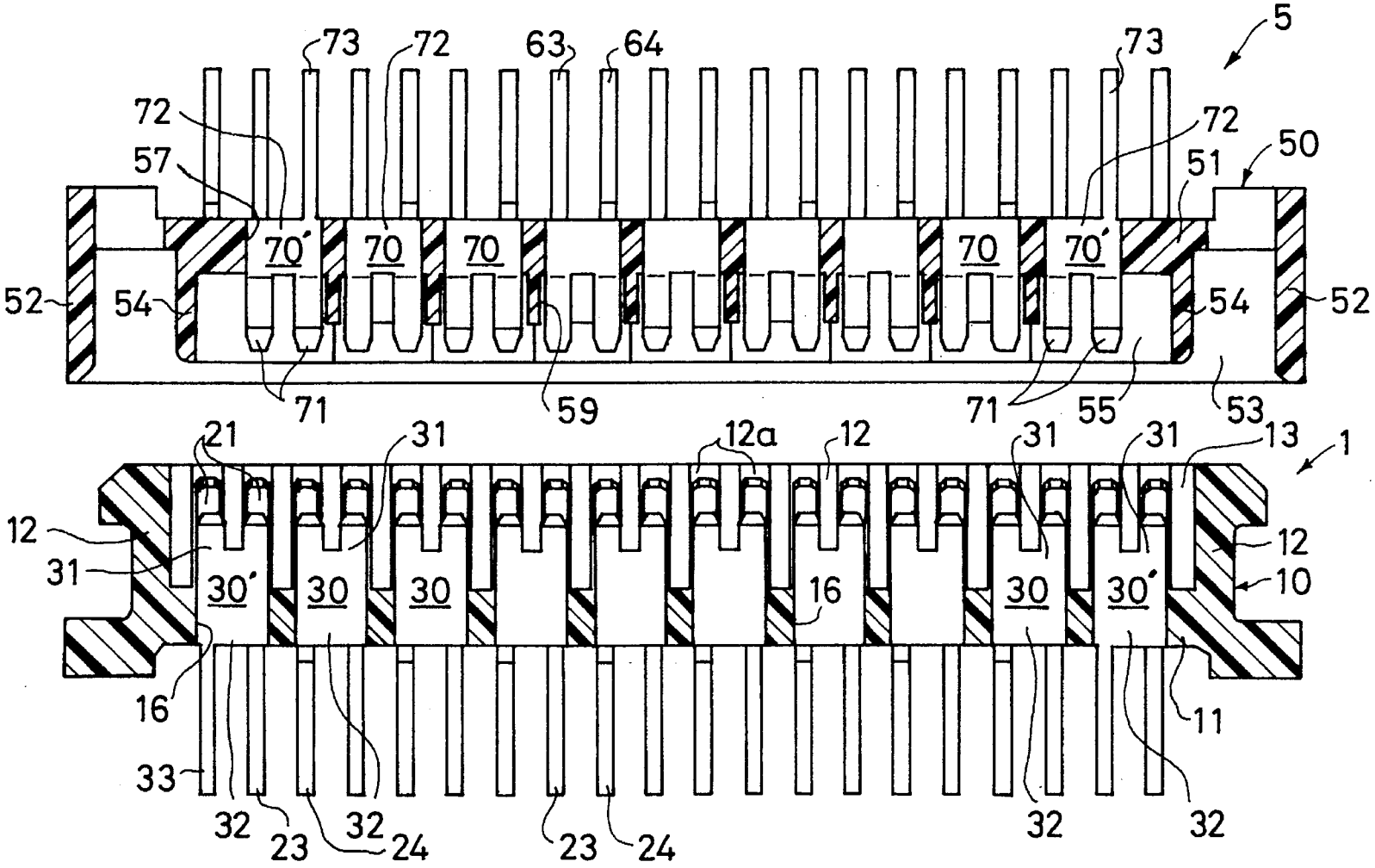
FIG. 3 shows a sectional view of the plug connector and the receptacle connector aligned opposite each other for mating.
Figure 4:
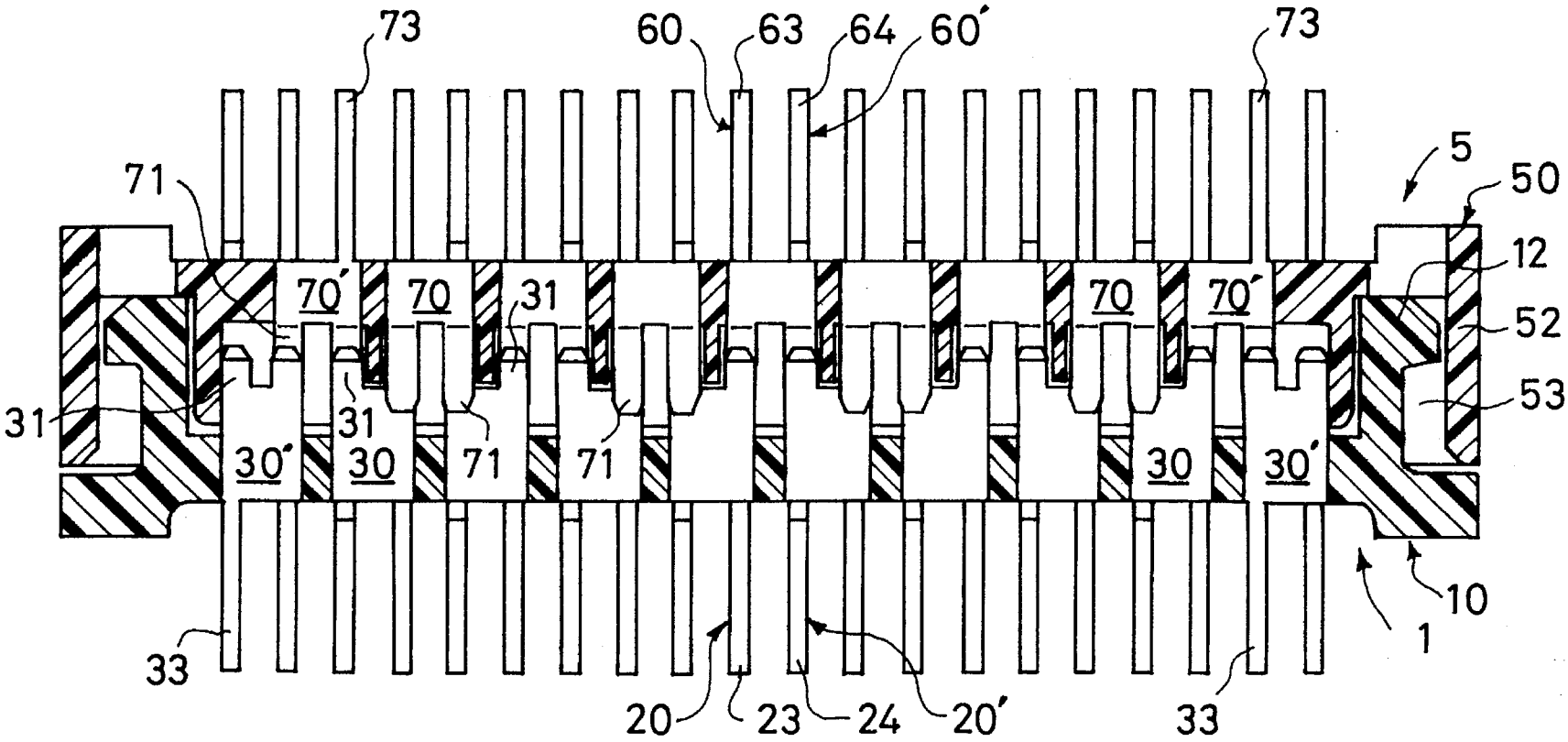
FIG. 4 shows a front, sectional view of the plug connector and the receptacle connector mated with each other.
Figure 5:
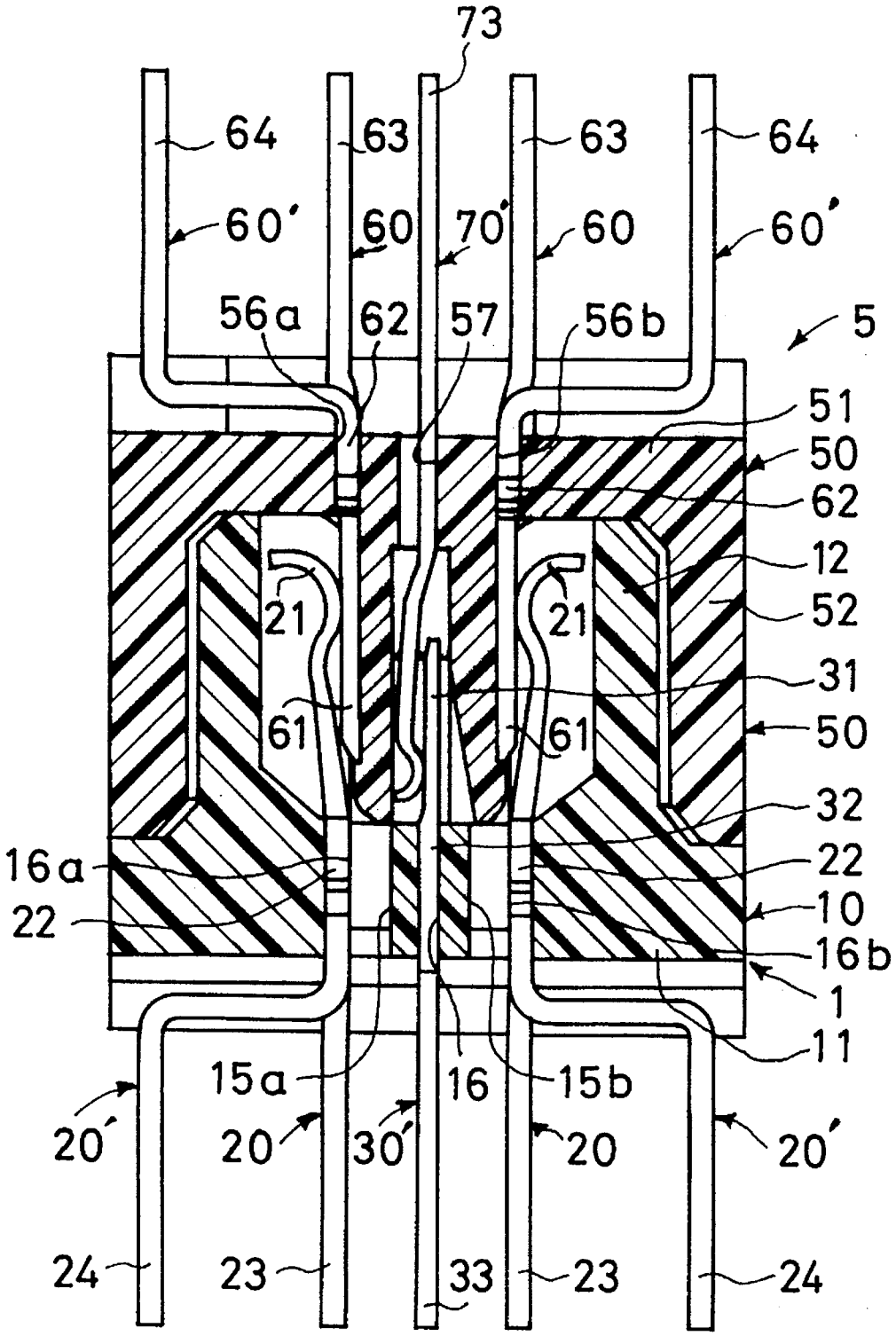
FIG. 5 shows a lateral or transverse, sectional view of the plug connector and the receptacle connector mated with each other.
Figure 6:
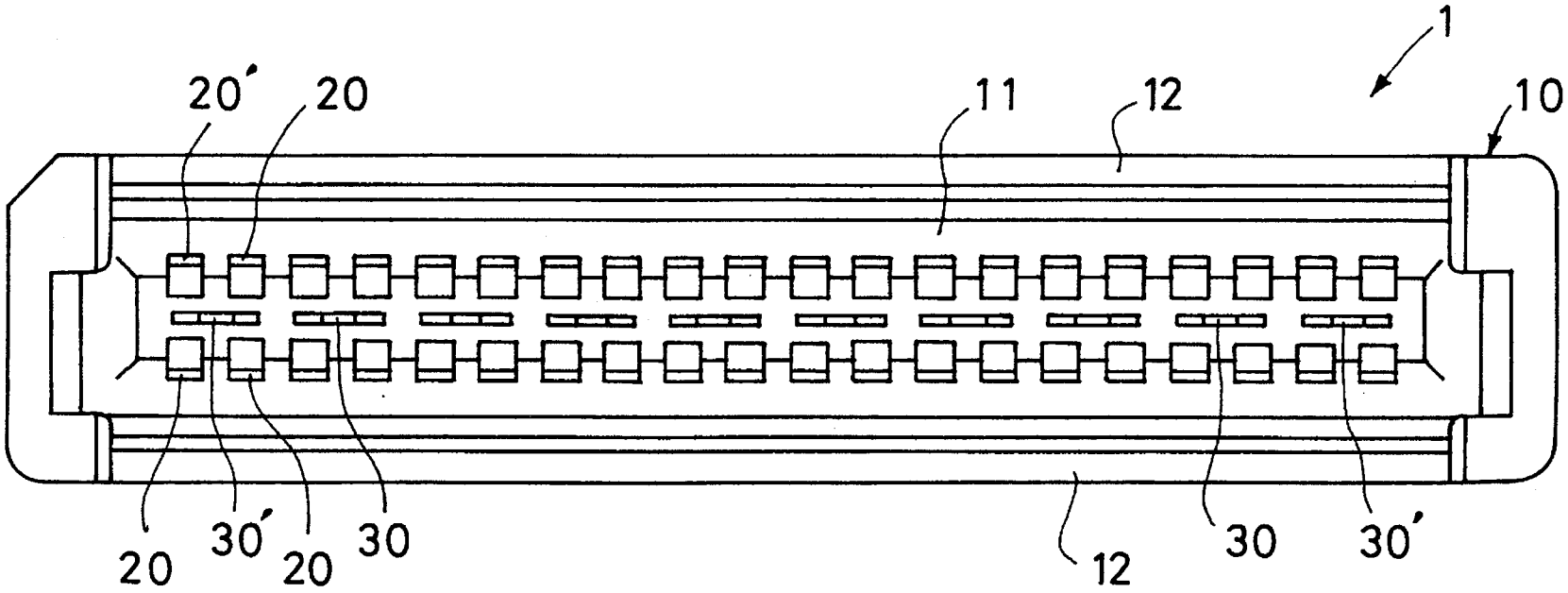
FIG. 6 shows a plan view of the receptacle connector.
Figure 7:
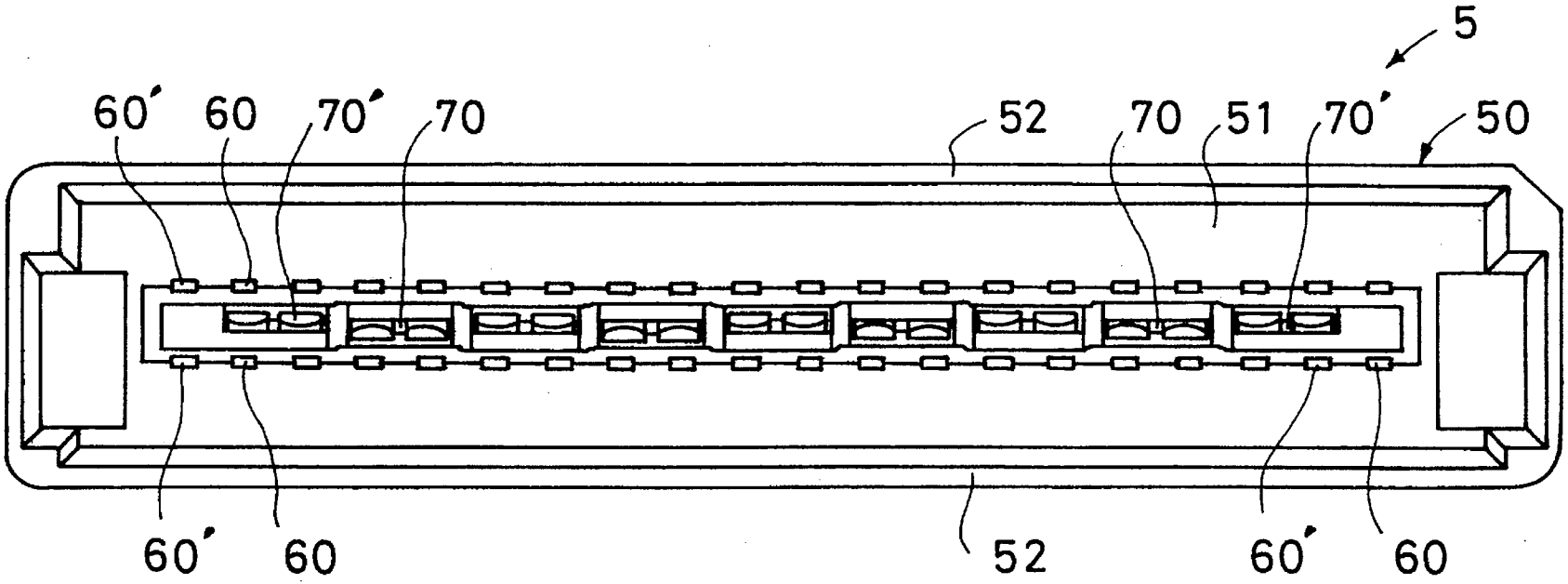
FIG. 7 shows a plan view of the plug connector.

A connector forming a first preferred embodiment of the present invention is shown in FIG. 1 to FIG. 7. This connector comprises a receptacle connector half 1 shown in FIG. 1 and a plug connector half 5 shown in FIG. 2, and both connector halves are interconnected when the receptacle connector 1 is fitted or mated with the plug connector 5, as shown in FIG. 4 and FIG. 5.

The receptacle connector 1 comprises a plurality of receptacle contacts 20 and 20*d* a plurality of receptacle center contacts 30 and 30' retained in a receptacle housing 10 formed of an electrically insulative material, as shown in the figures. The receptacle housing 10 is integrally formed as a one-piece body having a rectangular base portion 11 and a rectangular side-wall portion 12 upstanding therefrom forming a receptacle cavity 13 opening to an upper mating face. Three longitudinally extending rows of apertures 15*a*, 15*b* and slots 16 are formed through the base portion 11 in communication with the receptacle cavity longitudinally. Each of the apertures 15*a* and 15*b* is adjacent the major sides of the cavity and has a receptacle contact 20 or 20' stitched therein from the lower, board engaging, side, of the housing, and each of the slots 16 located at the center is provided with a center contact 30 or 30' stitched therein from the lower side of the housing. As all the contacts are stitched into the housing from the lower side, their assembly is simple. As shown in the figure, a plurality of contact guide grooves 12*a* are formed on the inner major surfaces of the side-wall portion 12 aligned with respective apertures 15*a* and 15*b*, respectively, so that the receptacle contacts 20 and 20', stitched into the apertures 15*a* and 15*b* are guided and inserted into the guide grooves 12*a*. Each receptacle contact 20 has a resilient contact portion 21 guided by a corresponding guide groove 12*a* and extending into the receptacle cavity 13, an anchoring portion 22 stitched into and retained in a corresponding aperture 15*a* or 15*b* and a lead portion 23 extending downwardly from the anchoring portion 22. Each receptacle contact 20' has an identical contact portion 21 and an identical anchoring portion 22 to those of the receptacle contact 20, but a different lead portion 24 which is bent at 90 degrees and extends horizontally (transversely) outwardly by a predetermined distance from the end of the anchoring portion 22 and then downwardly, (refer to FIG. 5). Both the receptacle contacts 20 and 20' are stamped and formed from sheet metal stock. The lower ends of their lead portions 23 and 24 are inserted into and soldered in through-holes of a circuit board, thereby mounting the receptacle connector 1 on the circuit board.

Figure 1:
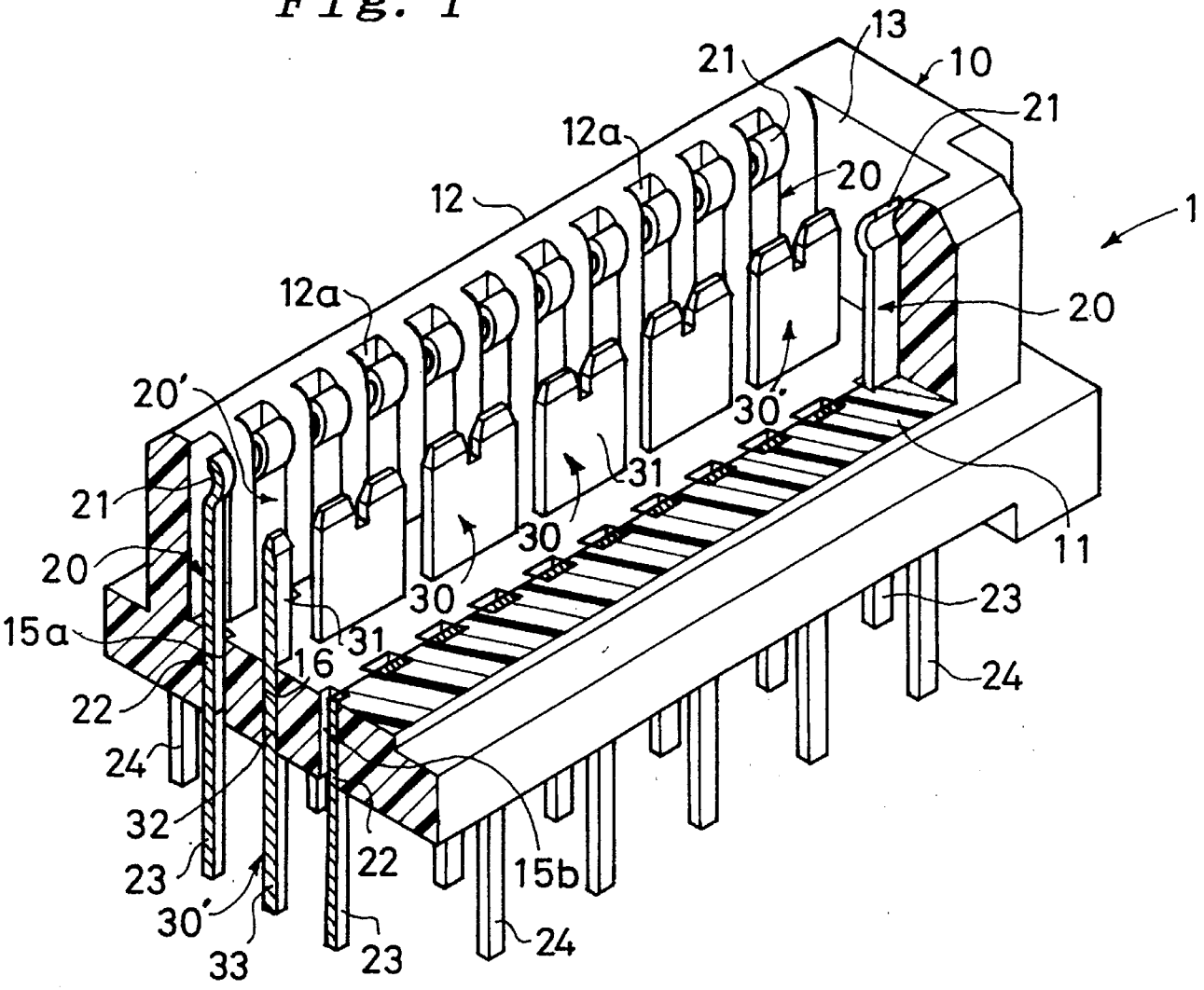
FIG. 1 shows a perspective, partially cut away view of a receptacle connector as a preferred embodiment of the present invention.

Each center contact 30 is also stamped and formed from sheet metal stock and includes an anchoring portion 32 stitched into and retained in the central slot 16 and a contact portion 31 extending upwardly from the anchoring portion 32. When the anchoring portions 32 are stitched into the central slots 16, the contact portions 31 extend into the receptacle-side cavity 13 and align longitudinally with a predetermined pitch p in the center of the receptacle-side cavity 13, as shown in FIG. 1. Each endmost center contact 30' is stitched into a central slot 16 located at each end of the row of the central slots 16 and has an identical contact portion 31 and an identical anchoring portion 32 to those of the center contact 30, and in addition to these portions, a lead portion 33 extending downwardly from the anchoring portion 32. When the receptacle connector 1 is mounted on a circuit board, the lead portion 33 is inserted into and soldered in a through-hole, whereby the lead portion 33 is connected through a circuit pathway tracing the through-hole to a power source or to ground.

The plug connector half 5 has a plurality of plug contacts 60 and 60*d*, a plurality of plug center contacts 70 and 70' retained in a housing 50 formed of an insulative material, as shown in the figure. The plug housing 50 is integrally formed as a one-piece body having a rectangular base portion 51, a rectangular outer wall portion 52, upstanding therefrom to an upper, mating face, and an inner wall portion 54 upstanding therefrom to an upper, mating face, inside the outer wall portion 52. As a result, on the base portion 51, an annular plug outer cavity 53 is created between the two wall portions 52 and 54, and an inner cavity 55 is created by the inner wall portion 52, both cavities opening to the mating face.

Two rows of longitudinally aligned apertures 56*a* and 56*b* are formed in the part of the base portion 51 extending along the inner-wall portions 54 on respective opposite lateral sides of the inner wall in communication with the plug outer cavity 53. A row of central slots 57 are formed extending longitudinally in a zigzag pattern in the part of the base portion 51 within the plug inner cavity 55. Each of the apertures 56*a* and 56*b* is provided with a plug contact 60 or 60' stitched therein from the lower face of the housing, and each of the central slots 57 is also provided with a center contact 70 or 70' stitched therein from the lower face of the housing. Thus, all the contacts are stitched into the housing from the lower face, so their assembly is simple. As shown in the figure, a plurality of upwardly extending guide grooves 54*a* are formed on the left-hand outer surface and right-hand outer surface wall] of the inner wall portion 54, at locations corresponding to the right and left hand apertures 56*a* and 56*b*, respectively, whereby the upper portions of the plug contacts 60 and 60' stitched into the apertures 56*a* and 56*b* are guided and inserted into the guide grooves 54*a*.

Each plug contact 60 includes a contact portion 61 guided by a corresponding guide groove 54*a* and extending in the plug outer cavity 53, an anchoring portion 62 stitched into and retained in a corresponding aperture 56*a* or 56*b*, and a lead portion 63 extending downwardly from the anchoring portion 62. Each plug contact 60' has an identical contact portion 61 and an identical anchoring portion 62 to those of the plug contact 60, but a different lead portion 64 which is bent through 90 degrees to extend horizontally outwardly for a predetermined distance from the end of the anchoring portion 62 and then extends downwardly (refer to FIG. 5). Both the plug contacts 60 and 60' are formed of an electrically conductive material, and the lower ends of their lead portions 63 and 64 are anchoring into and soldered at through-holes of a circuit board.

Each plug-side center contact 70 is also formed of a conductive material and includes a anchoring portion 72 stitched into and retained in a central slot 57 and a contact portion 71 extending upwardly from the anchoring portion 72. When the anchoring portions 72 are stitched into the central slots 57, the contact portions 71 protrude into the plug inner cavity 55. As shown in FIG. 3, endmost plug center contacts 70' which are stitched into the central slots 57 located at both ends of the row of the central slots 57 have identical contact portions 71 and identical anchoring portions 72 to those of the center contact 70, and in addition, a lead portion 73 extending downwardly from the anchoring portion 72. When the plug connector 5 is mounted on a circuit board, this lead portion 73 is inserted into and soldered at a through-hole, whereby the lead portion 73 is connected through a circuit pathway traced to the through-hole, e.g., to a power source or to the ground.

As shown in FIG. 2, the contact portions 71 of the plug center contacts 70 and 70' are not symmetrical in the direction of their thickness and are stitched into and retained in the central slots 57 which are formed in a row of zigzag pattern in such a way that alternate center contacts 70 or 70' have bifurcated contact portions with engaging surfaces facing in respective opposite lateral directions on respective opposite lateral sides of a center line of the row. These center contacts 70 and 70' are aligned longitudinally at the same pitch as that of the receptacle center contacts 30 and 30'.

As shown in FIG. 3 to FIG. 5, the receptacle connector 1 and the plug connector 5 constructed as described above are interconnected by fitting the side-wall portion 12 of the receptacle connector 1 into the plug outer cavity 53 of the plug connector 5. As a result, as shown in FIG. 5, the contact portion 21 of each receptacle contact 20 or 20' engages and electrically connects with the contact portion 61 of its corresponding plug contact 60 or 60'. At the same time, the contact portion 31 of each receptacle center contact 30 or 30' protrudes into the inner cavity 55 of the plug connector 5, whereby each receptacle-side center contact mates with its corresponding plug-side center contact connecting electrically thereto.

Although these receptacle center contacts 30 and 30' and plug center contacts 70 and 70' are aligned longitudinally with the same pitch, as shown in FIG. 4, the center contacts of the different rows are positioned such that when both the connectors 1 and 5 are interconnected, respective contacts of one row are offset longitudinally a distance of half he pitch with respect to the respective contacts of the other row. As a result, on :mating, for example, the right and left portions of a receptacle center contact 30 are in electrical engagement with left and right arms, respectively of the plug center contact 70. As a result, all the center contacts 30, 30' and 70,70' are electrically connected together, respective consecutive center contacts contacting, in a staggered fashion. The center contact 30' and 70' are grounded by their lead portions 33 and 73 when each lead portion is inserted into a through-hole connected for grounding on a circuit board, whereby all the center contacts grouped in a staggered fashion are grounded. As a result, all these center contacts together function as a shielding plate, preventing crosstalk from occurring among the receptacle contacts 20 and 20' and plug contacts 60 and 60'.

In the above embodiment, the center contacts 30' and 70' which have the lead portions 33 and 73, are positioned at both ends of the row. However, their locations are optional and can be chosen conveniently in order to increase the degree of freedom in positioning through-holes for grounding on the circuit board, thereby easing the work required in designing the circuit board. Further, the number of the center contacts 30' and 70' which have the lead portions 33 and 73, may be increased to provide more points for ground connection, thereby improving the shielding effect of the center contacts. Furthermore, in the above embodiment, by making the total heights of respective of the contact portions 31 and 71 of the center contacts higher than the total heights of respective of the contact portions 21 and 61 of the receptacle contacts and plug contacts, the center contacts, which are used for grounding, will be interconnected before the other contacts, which are used for signal transmission, when the receptacle connector 1 and the plug connector 5 are being mated together. In this way, the embodiment is constructed to perform a sequential connection of the contacts.

In reference to FIG. 8, another preferred embodiment of the present invention is as follows.

This connector comprises a receptacle connector 1' and a plug connector 5'. The receptacle connector 1' and the plug connector 5' are similar in construction to the receptacle connector 1 and the plug connector 5 of the previous embodiment. Therefore, identical parts of this embodiment will be described using the same numbers as used for the previous embodiment.

The receptacle housing 10 and receptacle contacts 20 and 20' of this receptacle connector 1' have the same constructions as those of the receptacle connector 1 shown in FIG. 1, so this embodiment only differs as follows:

1) The endmost central slots 16*b* are each occupied by a center contact which is for supplying power 130, but
2) the adjacent, penultimate central slots 16*a* remain empty, and
3) the other central slots 16*c* are each provided with a center contact for grounding 33' having the same configuration as that of the center contact which are stitched into the central slots located at both ends of the row of the receptacle connector shown in FIG. 1), which has a lead portion 33.

The center contact 130, for supplying power has a contact portion 131 extruding upwardly from an anchoring portion 132, which is stitched into the central slot 16*b*, and a lead portion 133, which extrudes downwardly therefrom. The height of each contact portion 131 is lower than the height of each contact portion 31 of the center contacts 30' for grounding. The lead portions 133 are inserted into through-holes which are traced to a power supply. Further, the plug housing 50 and plug contacts 60 and 60' of the plug connector 5' have the identical constructions as those of the plug connector 5, shown in FIG. 2, the differences are only as follows:

1) The central slots 57*a* located at both ends of the row are each occupied by a center contact 170 used for supplying power, but
2) the other central slots 57*b* are each occupied by a center contact 70' for grounding (having the same configuration as that of the center contact which is stitched into each endmost central slot of the plug connector shown in FIG. 2), which has a lead portion 73.

The center contact 170 for supplying power has a contact portion 171 extruding upwardly from an anchoring portion 172, which is stitched into the central slot 57*a*, and a lead portion 173, which extrudes downwardly therefrom. The height of the contact portions 171 is lower than the height of the contact portions 71 of the center contacts 70' for grounding. The lead portions 173 are inserted into through-holes which are traced to a power supply.

Figure 8:
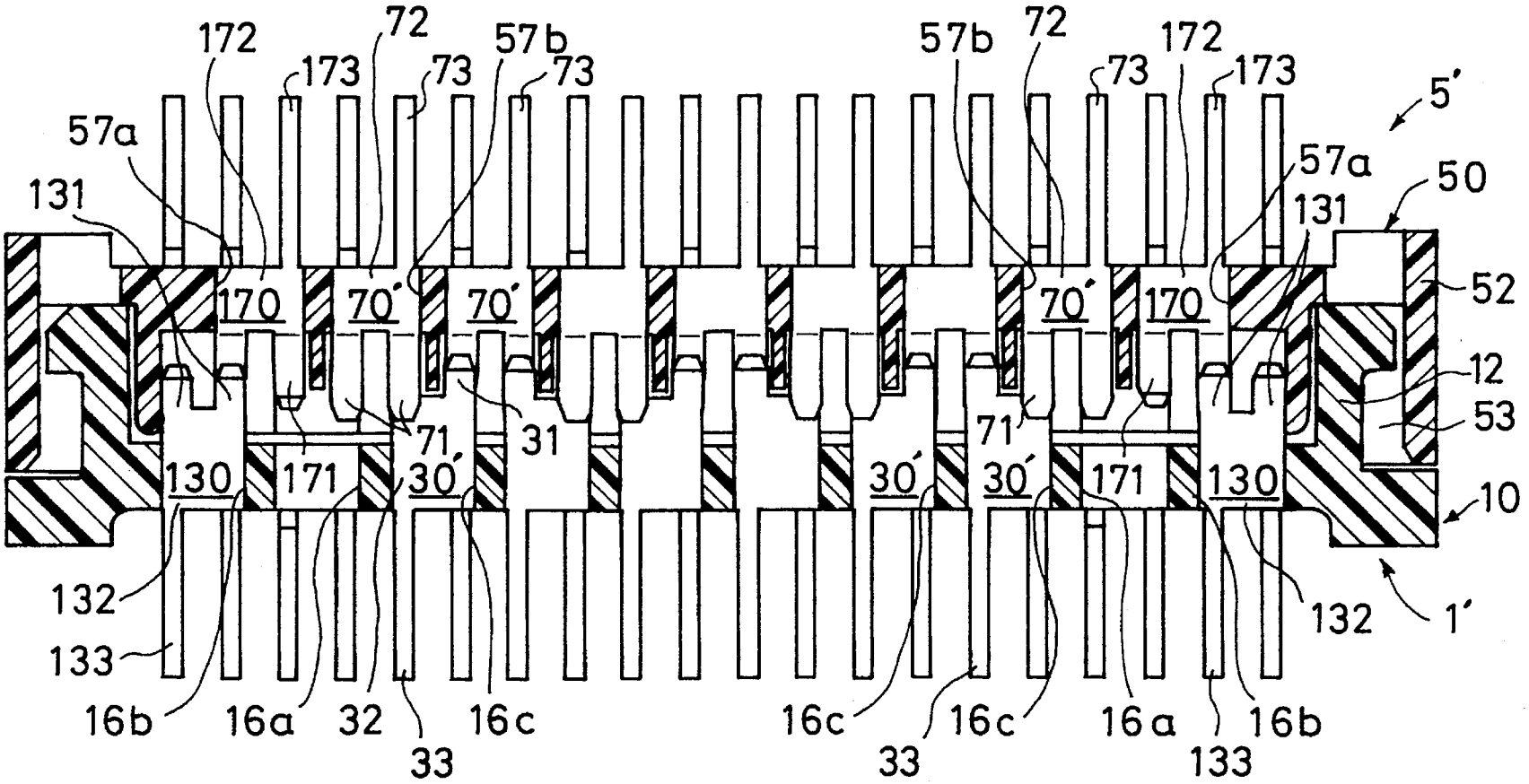
FIG. 8 shows a lateral or transverse, sectional view of another preferred embodiment of plug connector and another preferred embodiment of receptacle connector mated together.

FIG. 8 shows the receptacle connector 1' and plug connector 5 intermated. This condition allows the center contacts 31 and 171 for supplying power, which are positioned at both ends of the row, to be interconnected electrically. The center contacts 131 and 171 for supplying power are separated from the other center contacts 30' and 70' when the central slots 16*a* next to both end slots of the row of the receptacle connector are left empty without center contacts.

The center contacts 30' and 70' for grounding are connected together consecutively in a staggered fashion in a row in the same way as shown in FIG. 1 to FIG. 7. A result, all the center ground contacts are electrically connected in an group and function as a shielding plate.

In the connector shown in FIG. 8, the center contacts for supplying power, which are positioned at both ends, are to be connected to a power-supply line, and the remaining center contacts, i.e., the center ground contacts, are separated from the center contacts for supplying power and function as a shielding plate. In this embodiment, the total heights of the contact portions 131 and 171 of the center contacts 130 and 170 for supplying power is lower than that of the contact portions 31 and 71 of the center contacts 30' and 70' for grounding. Further, the total heights of the contact portions 21 and 61 of the receptacle contacts and plug contacts is lower than that of the contact portions 131 and 171 of the center contacts 130 and 170 for supplying power. Therefore, when the receptacle connector 1' and the plug connector 5' are mated with each other, the center ground contacts are connected first, then the center contacts for supplying power are connected, and lastly the contacts for transmitting signals (the plug contacts and receptacle contacts) are connected, thereby establishing a sequential connection.

Furthermore, in this embodiment, all the center ground contacts are each provided with a lead portion 133 or 173. However, it is necessary only for at least one center contact for grounding to have a lead portion.

By reducing the number of lead portions and selecting which center contact is to be provided with a lead portion, the degree of freedom in positioning through-holes for grounding on the circuit board is increased.

The function of a completely standard connector can therefore be altered on site to suit any particular requirement simply by removing any one or more center contacts from one or more selected slots so that only a connector of single design need be manufacture thereby reducing costs of inventory and tooling.

What is claimed is:

1. An electrical connector comprising:

a first connector half having a plurality of first contacts retained in two longitudinally extending rows in an insulative housing, a second connector half having a plurality of second contacts retained in two longitudinally extending rows in an insulative housing, the first connector half being matable with the second connector half to connect the first contacts with respective, corresponding, second contacts, a plurality of third contacts retained in the first connector half, between the two rows of first contacts and aligned longitudinally with each other and at a predetermined pitch, and a plurality of fourth contacts retained in the second connector half between the two rows of second contacts, aligned longitudinally with each other and at a pitch which is the same as the pitch of the third contacts;

so that, in a mated position of the connector halves, the fourth contacts are offset, longitudinally, by a distance of half the pitch with respect to the third contacts, and respective, successive single third contacts engage longitudinally spaced apart, adjacent portions of respective different successive fourth contacts, thereby electrically connecting respective, third contacts and respective fourth contacts consecutively.

2. The electrical connector set forth in claim 1 wherein said first connector half is a receptacle connector, and said second connector half is a plug connector.

3. The electrical connector set forth in claim 2 wherein each of said third contacts includes a male terminal protruding into a receptacle cavity, and each of said fourth contacts includes a female terminal positioned in a socket receiving cavity which is formed between the rows of said second contacts in the plug connector, whereby the third contacts and the fourth contacts are interconnected so that the male terminals are received in the female terminals when said first connector half and said second connector half are mated with each other.

4. The electrical connector set forth in claim 1 wherein said first contacts and said third contacts are stitched into said first connector half, and said second contacts and said fourth contacts are stitched into said second connector half.

5. The electrical connector set forth in claim 1 wherein said third contacts and said fourth contacts constitute grounding contacts, and at least one of the third and fourth contacts includes a lead portion for connection to a grounding terminal.

6. The electrical connector set forth in claim 5 wherein endmost of said third contacts and endmost of said fourth contacts are positioned at both ends of said rows and each endmost contact includes a lead portion for connection to a grounding terminal.

7. The electrical connector set forth in claim 1 wherein a maximum total height of contact portions of said first contacts and respective, corresponding contact portions of said second contacts, which are to be electrically connected is less than a maximum total height of contact portions of said third contacts and of respective, corresponding fourth contacts, which are to be electrically connected whereby said third contacts and said fourth contacts are brought into electrically connecting engagement before electrical engagement of said first contacts and said second contacts during mating movement of said first connector half and said second connector half.

8. The electrical connector set forth in claim 1 wherein removal of at least one of said third contacts or at least one of said fourth contacts divides the consecutively connected third and fourth contacts into at least two electrically isolated groups of consecutively connected third and fourth contacts, thereby enabling one group to be used for grounding and another group for supplying power.

9. The electrical connector set forth in claim 8 wherein a maximum total height of contact portions of said first contacts and respective, corresponding contact portions of said second contacts, which are to be electrically connected is less than a maximum total height of respective, corresponding contact portions of the group of contacts for grounding;

a maximum total height of respective, corresponding contact portions of the group of contacts for grounding, which are to be electrically connected is greater than a maximum total height of respective, corresponding contact portions of the group of contacts for supplying power, which are to be electrically connected; and, a maximum total height of contact portions of said first contacts and respective, corresponding contact portions of said second contacts, which are to be electrically connected, is less than a maximum total height of respective, corresponding contact portions of the group of contacts for supplying power;

whereby during mating movement of said first connector half and said second connector half, electrical connection is established firstly with said group of contacts for grounding electrical connection is established secondly with said group of contacts for supplying power and lastly electrical connection is established between said first contacts and said second contacts.

10. The electrical connector set forth in claim 1 wherein engaging surfaces of alternate fourth contacts face in respective opposite directions transversely of their row so as to engage respective opposed facing sides of alternate third contacts when the first and second connector halves are intermated to provide a longitudinally extending compound row of contacts connected in staggered relation.

11. The electrical connector set forth in claim 1 wherein at least some of the fourth contacts have bifurcated contact portions providing respective pairs of resilient, longitudinally spaced contact arms which form the said longitudinally adjacent portions engaged by the successive third contacts.

12. An electrical connector comprising:

a first connector half having a plurality of first contacts retained in two longitudinally extending rows in an insulative housing, a second connector half having a plurality of second contacts retained in two longitudinally extending rows in an insulative housing, the first connector half being matable with the second connector half to connect the first contacts with respective, corresponding, second contacts a plurality of third contacts retained in the first connector half, between the two rows of first contacts and aligned longitudinally with each other and at a predetermined pitch, and a plurality of fourth contacts retained in the second connector half between the two rows of second contacts, aligned longitudinally with each other and at a predetermined pitch, so that, in a mated position of the connector halves, respective, successive single third contacts are in longitudinal bridging engagement with respective, successive fourth contacts thereby electrically connecting respective, third contacts and respective fourth contacts consecutively.

13. The electrical connector set forth in claim 11 wherein engaging surfaces of alternate fourth contacts face in respective opposite directions transversely of their row so as to engage respective opposed facing sides of alternate third contacts when the first and second connector halves are intermated to provide a longitudinally extending compound row of contacts connected in staggered relation.

14. The electrical connector set forth in claim 12 wherein at least some of the fourth contacts have bifurcated contact portions providing respective pairs of resilient, longitudinally spaced contact arms which form the said longitudinally adjacent portions engaged by the successive third contacts.

* * * * *

UNITED STATES PATENT AND TRADEMARK OFFICE

CERTIFICATE OF CORRECTION

PATENT NO. : 5,618,191
DATED : April 8, 1997
INVENTOR(S) : Koji Chikano

It is certified that error appears in the above-identified patent and that said Letters Patent is hereby corrected as shown below:

On the title page, insert item [30] -- Foreign Application Priority Data:
Nov. 11, 1994 [JP] Japan.....6-302987 --

Signed and Sealed this

Sixth Day of January, 1998

*Attest:*

Bruce Lehman

BRUCE LEHMAN

*Attesting Officer*

*Commissioner of Patents and Trademarks*